United States Patent [19]

Carlson

[11] 4,422,629

[45] Dec. 27, 1983

[54] RANGE JAWS FOR MILLING MACHINE VISES

[76] Inventor: Alfred J. Carlson, 9926 W. 143rd Pl., Orland Park, Ill. 60462

[21] Appl. No.: 381,192

[22] Filed: May 24, 1982

[51] Int. Cl.[3] ..... B25B 1/24

[52] U.S. Cl. ..... 269/282; 269/283

[58] Field of Search ..... 269/271, 282, 283, 279–280

[56] References Cited

U.S. PATENT DOCUMENTS

| | | | |
|---|---|---|---|
| 800,685 | 10/1905 | Scoggins | 269/283 |
| 2,741,145 | 4/1956 | Bahorik | 269/282 |
| 2,876,667 | 3/1959 | Smith | 269/282 |
| 3,006,226 | 10/1961 | Poysa | 269/283 |
| 4,078,782 | 3/1978 | Carlson | 269/283 |
| 4,306,709 | 12/1981 | Hurn | 269/283 |

*Primary Examiner*—Robert C. Watson

*Attorney, Agent, or Firm*—Robert D. Farkas

[57] ABSTRACT

An accessory apparatus for vises utilize a pair of accessory members, one of which has a Z-shaped cross-section and means to removeably secure the Z-shaped cross-section to the stationary nonmoveable portion of the vise. The other accessory member is provided having a Z-shaped cross-section and means to secure the other accessory member to the moveable portion of the vise. The Z-shaped cross-section is configured to have its central region residing on the uppermost portion of the vise. One leg of each of the Z-shaped cross-shaped sections, protruding upwardly from the vise are provided having a pair of removeably jaws secured thereto. A plate may be removeably secured to the uppermost surface of the Z-shaped cross-section secured to the moveable portion of the vise, having one end configured to accommodate the pair of plates secured to the upstanding leg of such Z-shaped cross-section. The other end of the plate is similarly provided having two plates secured thereto. Three ranges of gripping areas are thus provided, two of which are provided having zero radius gripping corners on the plates supporting the work clamped by the apparatus.

9 Claims, 3 Drawing Figures

RANGE JAWS FOR MILLING MACHINE VISES

BACKGROUND OF THE INVENTION

1. The Field of the Invention

The present invention relates to vises and accessory apparatuses utilized therewith, and more particularly to that class of accessory devices which permits work pieces to be clamped by the vise along a dimension thereof greater than the normal open maximum open jaw dimension of the vise, not otherwise equipped with the accessories.

2. Description of the Prior Art

The prior art abounds with vises utilized to successfully clamp work pieces within the vise mechanism such that the work pieces may have varied dimensions otherwise not easily clamped in between the stationary and moveable jaws of the vise. U.S. Pat. No. 3,184,228, issued on May 18, 1965 to E. Z. Chenette et al. teaches a moveable device which may be installed to a stationary jaw of a vise such that work pieces may be clamped between the stationary jaw accessory and the moveable jaw thereof.

U.S. Pat. No. 4,078,782, issued Mar. 14, 1978 to me discloses accessory apparatuses for vises which employ one Z-shaped member and one L-shaped member for extending the range of useful clamping length of work pieces. My invention, described in U.S. Pat. No. 4,078,782, provides that one or more bars are secured to the L-shaped member, utilizing grooves therefor. Such grooves may be in spaced apart relationship, extending outwardly from the stationary jaw of the vise, and parallel thereto. The bars are expensive to manufacture, and are difficult to fabricate so as to have a clamping and supporting surfaces, in the corner of the work to be grasped, having a zero radius. Additionally, such bars do not add to the flexural strength of the L-shaped member, due to their narrow width and the required grooves that must be formed in the L-shaped member. Another disadvantage that my earlier invention precludes the use of a convenient clamping surface, on the uppermost surface of the L-shaped member, for clamping work pieces, other than in between the reciprocating jaws of the vise or the jaws formed by the accessory elements.

SUMMARY OF THE INVENTION

A primary object of the present invention is to provide an accessory apparatus for conventional vises such that work pieces whose clamp length exceeds the stroke range of the vise may be adequately grasped by a vise mechanism having the accessory element removeably secured thereto.

Another object of the present invention is to provide an accessory apparatus for vises whose clamping dimension is within the stroke range of the vise when the accessory devices are removeably fitted to and fastened onto the vise apparatus.

Still another object of the present invention is to provide a device which may be fitted with accessory clamping devices such that the vise may be closed down onto a work piece having a clamping thickness of any dimension up to the extended maximum clamping range of the device and intermediary steps thereto, whilst providing a supporting surface for the work piece, and a pair of clamping surfaces which are adjacent to one another, and which have a zero radius in a corner formed thereby.

Yet another object of the present invention is to provide an accessory apparatus for a vise which may be easily and conveniently installed on existing vises, and when removed, permit such vises to be utilized in their conventional fashion.

A further object of the present invention is to provide an accessory apparatus for a vise, which when installed to the vise provides a working surface to which may be bolted, or alternatively clamped, or, if desired, a combination of the two, at the will of the user.

Another object of the present invention is to provide an accessory apparatus for vises which are inexpensive to manufacture, particularly suited for the purpose for which they are intended, easily attached to and removed from a milling machine vise, wherein work contacting jaws may be easily replaced, when worn or otherwise require replacement.

Heretofore, when it was desired to support a work piece on the bed of a machine tool, such as a milling machine, required the use of two supporting blocks, as well as a means to either exert sideward force or downward force on the work piece, so as to effectively clamp the work piece on the supporting blocks securely to the bed of the machine. Alternatively, a milling machine vise, well known in the art, could be utilized to grasp the edges of the work piece between a stationary and a moveable jaw, which work piece was firstly supported on at least two blocks of uniform height placed on the bed of the vise and below the work piece. Of necessity, the supporting block edge communicating with the jaws of the milling machine were required to form a zero radius corner so as to permit a work piece to be supported vertically near its outermost edge and clamped within the vise jaws at sides of the work piece adjacent such edge. It is highly impractical to place supporting blocks, even in removeable fashion, against the faces of a conventional milling machine vise, because to do so would necessarily prevent the grasping of narrow pieces, whose opposite closely spaced edges would ordinarily be grasped by the stationary jaw and the moveable jaw of the vise. Such is not case, however, when utilizing an accessory apparatus, which apparatus can be equipped with such supporting blocks and grasping faces having a zero radius corner therein between, since the accessory apparatus is particularly useful in grasping and supporting work pieces whose surfaces to be clamped exceed the maximum opening dimension of the vise not otherwise equipped with the accessory apparatus.

The present invention contemplates and resolves the aforementioned problems, and provides the solution to additional work grasping and securing problems. For example, a milling machine vise, when attached to the moveable bed of a milling machine, requires a substantial amount of effort to remove and replace same, in the central regions of such moveable bed. Oft times a milling machine vise will be improperly placed, often from the mid-region of the moveable bed of the milling machine so as to avoid the need to remove entirely the vise when it is desired to clampingly engage a work piece directly to the slotted moveable bed of the milling machine. The present invention includes clamping means for work pieces, to be secured to a portion of the accessories taught herein, permitting the improved milling machine vise and its accessories to be kept in the proper position once mounted therein, upon the moveable bed of the milling machine.

Additionally, the present invention permits specially shaped work grasping jaws to be secured to an accessory portion of the present apparatus that is inexpensive to manufacture and can be easily customized to perform the clamping of the work piece to an accessory portion of the present invention. By rotating the milling machine vise so as to have its longitudinal axis disposed at an angle relative to the longitudinal axis of the work table, the work piece so supported may be transported along a path parallel to the longitudinal axis of the milling machine vise, without having to simultaneously transport the milling machine bed in two directions simultaneously.

These objects as well as other objects of the present invention will become more readily apparent after reading the following description of the accompanying drawings.

DESCRIPTION OF THE PREFERRED EMBODIMENT

Figure 1:
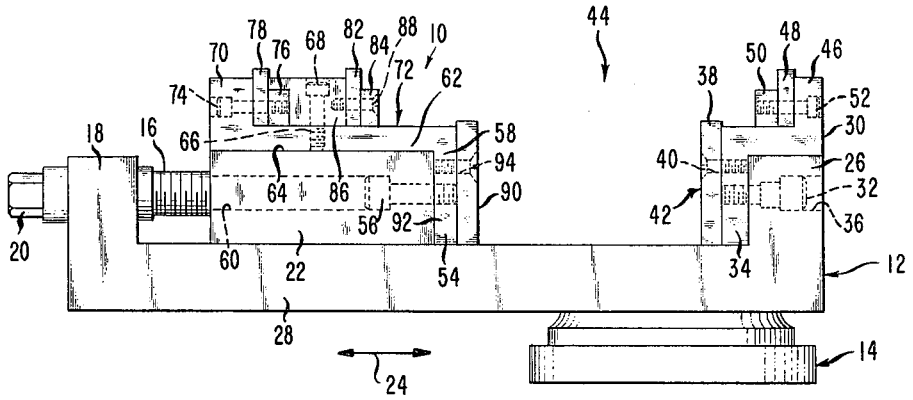
FIG. 1 is a side elevation view of the present invention shown attached to a conventional milling machine vise.
Figure 2:
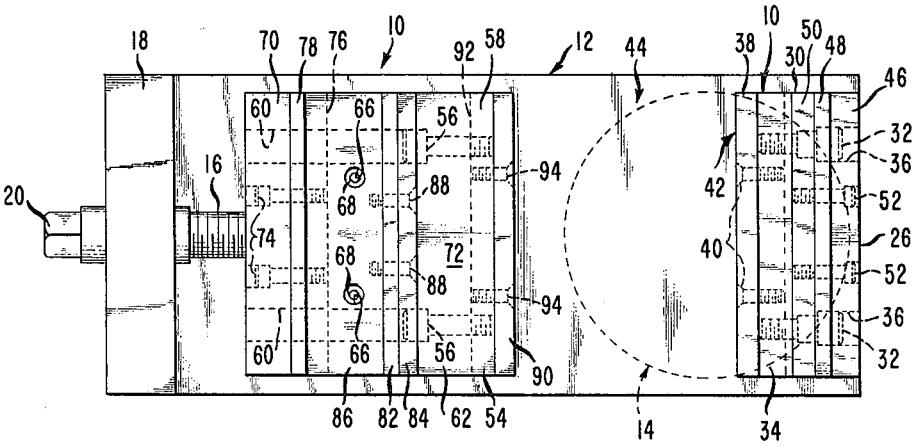
FIG. 2 illustrates a top view of the apparatus shown in FIG. 1.

Turning descriptively to the drawings in which similar reference characters denotes similar elements throughout the separate views. FIGS. 1 and 2 illustrate the present invention 10 shown secured to a conventional milling machine vise 12. Vise 12 is provided having base 14 adapted for mounted to a suitable support surface, not shown, such as a moveable table comprising a portion of a milling machine or drill press, or the like. Lead screw 16 is threadingly engaged within leg 18 of vise 12. End 20 of lead screw 16, when rotated, causes moveable block 22 to move in the directions of arrows 24. Leg 26 is shown intricately secured to vise base portion 28, upon which block 22 is supported in any of its various locations. A Z-shaped member 30 is secured to end 26, utilizing bolts 32 therefor the threaded ends of bolts 32 are threadingly secured leg 34 of Z-shaped member 30. Clearance holes 36 are machined in end 26. Work gripping plate 38 is secured to Z-shaped member 30, utilizing screws 40 therefor. Surface 42 of work gripping piece 38 may be utilized to grasp work piece, not shown, when engaged within cavity 44. Leg 46 of Z-shaped member 30 is shown having work clamping plate 48 and work supporting block 50 secured thereto, utilizing screws 52 therefor. The threaded ends of screws 52 are threadingly engaged within supporting blocks 50. By simple removal of screws 36, Z-shaped member 30 and its attachments comprising work clamping piece 38, work clamping piece 48 and work supporting bar 50, are disengaged from member 26, a stationary member of vise 12.

Another Z-shaped member 54 is secured to moveable member 22, utilizing the screws 56 therefor. Threaded ends of screws 56 are engaged within leg 58 of Z-shaped member 54, by passing through holes 60. Intermediate portion 62, of Z-shaped member 54, resides over and resting upon surface 64 of moveable block 22. Intermediate portion 62 is shown provided having threaded holes 66, in which screws 68 may be threadingly engaged. Leg 70 of Z-shaped member 54 extends upwardly from uppermost surface 72 of intermediate portion 62. Bolts 74 pass through leg 70 of Z-shaped member 54 threadingly engaging supporting block 76 as well as capturing work clamping piece 78 between work supporting block 76 and leg 70. Another work clamping piece 82 and work supporting block 84 are shown secured to plate 86 by screws 88. Work clamping piece 90 is shown secured to leg 92 of Z-shaped member 54, utilizing screws 94 therefor.

By removing screws 68, plate 86, shown carrying clamping piece 82 and supporting block 84 may be disengaged from surface 72 of intermediary portion 62 of Z-shaped member 54. When this is done, work clamping piece 78 acts in conjunction with work clamping piece 48, wherein a work piece, not shown, can be supported on blocks 50 and 76. In this condition, the apparatus has its maximum opening dimension determined by only the position of slideable block 22 along the length of base portion 28, as controled by the rotation of lead screw 16. When plate 86 is secured to intermediary portion 62, work clamping elements 48 and 82, in conjunction work supporting blocks 50 and 84, may be utilized to clamp together another work piece, not shown, whose clamping dimension is of intermediate length. At all other times, work clamping pieces 38 and 90 may be employed, in conventional fashion, employing other work supporting blocks, not shown. In such use, the work piece is so supported must have a clamping length not greater than the maximum opening defined by opening 44.

Figure 3:
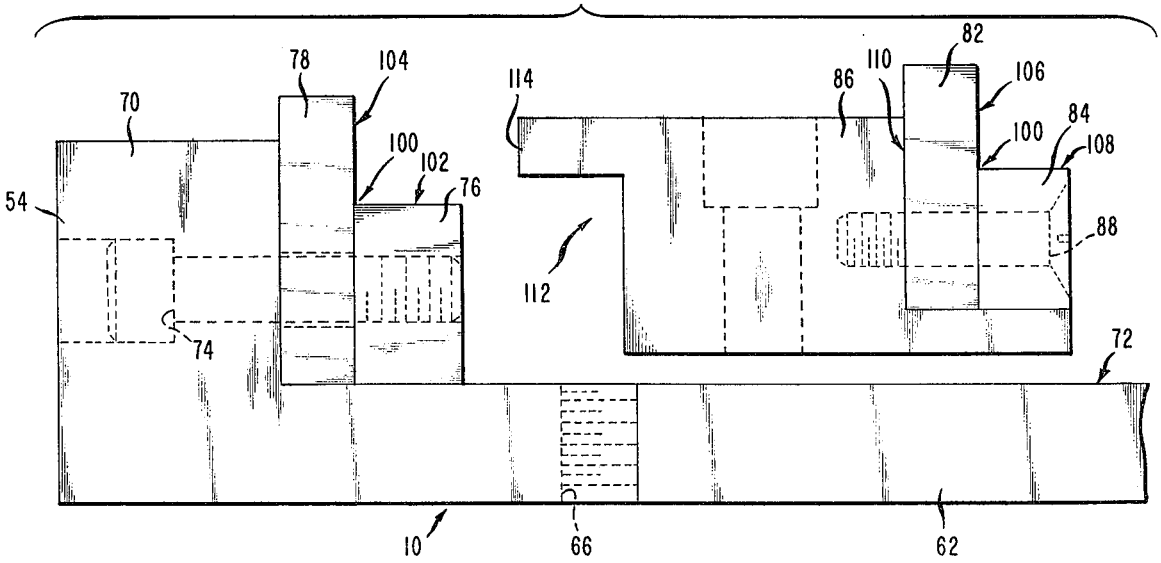
FIG. 3 is an enlarged side elevation view of a portion of the apparatus shown in FIG. 1.

FIG. 3 illustrates supporting block 76 being threadingly engaged with screw 74, clamping member 78 between support block 76 and end 70 of Z-shaped member 54. It should be noted that corners 100 have a zero radius, permitting work pieces, not shown, having supporting surface at right angles to a clamping surface, to be supported by uppermost surface 102 and 104 of supporting blocks 76 and 84 respectively, whilst their clamping surfaces, not shown, may be engaged with clamping surface 104 and 106 of clamping plates 78 and 82 respectively. Surface 102 of supporting block 76, surface 104 of supporting block 84, and the uppermost surface of supporting block 50, as shown in FIG. 1, all reside in a common plane, when additional plate 86 is secured to surface 72 of Z-shaped element 62. The uppermost surfaces of clamping plates 78, 82 and 48 are also equi-distant from surface 72 or a projection thereof. The uppermost surface of clamping plates 90 and 38 are similarly equally spaced from the surface upon which moving block 22 resides. Holes 66, shown in FIGS. 2 and 3, may be supplemented to show a pattern of threaded holes in surface 72, adapted for mounting and clamping to surface 72, a plurality of work pieces. Additional plate 86, those shown in FIGS. 1 and 2 as having a substantially rectangular cross section, may be modified so as to have surface 110 configured to reside any shape work piece intended to be clamped by such modified surface and by opposed clamping element 48. Notch 112, located in plate 86, accommodate supporting block 76, when end 114 of block 86 is engaged resting against surface 104 of clamping plate 78.

One of the advantages of the present invention is an accessory apparatus for conventional vises such that work pieces whose clamp length exceeds the stroke range of the vise may be adequately grasped by a vise mechanism having the accessory element removeably secured thereto.

Another advantage of the present invention is an accessory apparatus for vises whose clamping dimension is within the stroke range of the vise when the accessory devices are removeably fitted to and fastened onto the vise apparatus.

Still another advantage of the present invention is a device which may be fitted with accessory clamping devices such that the vise may be closed down onto a work piece having a clamping thickness of any dimension up to the extended maximum clamping range of the device and intermediary steps thereto, whilst providing a supporting surface for the work piece, and a pair of clamping surfaces which are adjacent to one another, and which have a zero radium in a corner formed thereby.

Yet another advantage of the present invention is an accessory apparatus for a vise which may be easily and conveniently installed on existing vises, and when removed, permit such vises to be utilized in their conventional fashion.

A further advantage of the present invention is an accessory apparatus for a vise, which when installed to the vise provides a working surface to which work may be bolted, or alternatively clamped, or, if desired, a combination of the two, at the will of the user.

Another advantage of the present invention is an accessory apparatus for vises which are inexpensive to manufacture, particularly suited for the purpose for which they are intended, easily attached to and removed from a milling machine vise, wherein work contacting jaws may be easily replaced, when worn or otherwise require replacement.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only the the appending claims.

The embodiment of the invention in which an exclusive privilege or property is claimed are defined as follows:

I claim:

1. In the combination of a vise, the vise having a stationary end member, the moveable end member having a flat elongated upper surface, said flat elongated upper surface being substantially normal to a work piece clamping surface located on the moveable end member, said vice including a stationary flat surface extending between said stationary member and said moveable end member, the improvement comprising a first accessory member, a second accessory member, a third accessory member, the first accessory member having a Z-shaped cross-section, said Z-shaped cross-section of said first accessory member including removeable joining means for joining said first Z-shaped cross-section accessory member to said moveable end member, said second accessory member having a second Z-shaped cross-section, said second Z-shaped cross-section of said second accessory member including means to removeably join said second accessory member to said stationary end member, said first accessory member including a first leg portion and a second leg portion and a portion intermediate said first leg portion and said second leg portion, said second leg of said first accessory member having a free end, said free end of said second leg of said first accessory member being disposed in sliding touching engagement with said stationary flat surface, said second accessory member including a first leg portion and a second leg portion and a portion of said second accessory member intermediate said first leg portion and said second leg portion, said second leg portion of said second accessory member having a free end, said free end of said second leg portion of said second accessory member residing in touching engagement with said flat surface, said intermediate portion of said first accessory member including a pair of lateral surfaces, said pair of lateral surfaces being disposed in spaced apart parallel relationship, said pair of lateral surfaces extending intermediate said first leg portion and said second leg portion of said first accessory member, said third accessory member including means for removeably securing said third accessory member to said first accessory member, said third accessory member being provided having an outermost surface configured to rest upon one of said pair of lateral surfaces, said intermediate portion of said first accessory member having the other of said pair of lateral surfaces configured to reside upon said flat elongated upper surface of said moveable end member, said second accessory member having a supporting surface configured to reside upon a lateral surface of said stationary end member, a first supporting block, a first clamping plate member, means to removeably secure said first clamping block and said first clamping plate to said first leg of said first accessory member, a second supporting block a second clamping plate, means to removeably secure said second supporting block and second clamping plate to a leg of said second accessory member, a third supporting block, a third clamping plate, a third clamping member, means to removeably secure said third supporting block and said third clamping plate to a surface of said third clamping member, a surface of said first supporting block and a surface of said first clamping plate being disposed at right angles to one another, a surface of said second supporting block and a surface of said second clamping plate being disposed at right angles to one another, a surface of said third supporting block and a surface of said third supporting clamping plate being disposed at right angles to one another, wherein said supporting surface of said first accessory member defines a plane, said surface of said first supporting block and said surface of said second supporting block and said surface of said third supporting block being disposed equidistant from said plane, wherein said third accessory member comprises one end and another end and at least one lateral surface, thereinbetween, a notch, said notch being located on said one end of said first accessory member, said notch being configured to accommodate said first supporting block residing therewithin when said at least one lateral surface of said third accessory member is disposed clampingly engaged to said supporting surface of said first accessory member.

2. The apparatus as claimed in claim 1 wherein said means to removeably secure said first accessory member to said moveable end member comprises said second leg of said first accessory member including at least one threaded hole therewithin, a bolt, said bolt being disposed removeably threadingly engaged with said hole, said bolt removeably clampingly engaging said second leg of said first accessory member to said moveable end member.

3. The apparatus as claimed in claim 1 wherein said intermediate portion of said first accessory member includes at least one threaded hole therein.

4. The apparatus as claimed in claim 1 wherein said means to removeably secure said third accessory member to said first accessory member include at least one threaded hole being disposed in said intermediate portion of said first accessory member, a bolt, said bolt removeably clampingly engaging said third accessory member to said supporting surface of said intermediate portion of said first accessory member.

5. The apparatus as claimed in claim 1 further comprising a pair of clamping plates, means to removeably secure one of said pair of clamping plates to said first accessory member, means to removeably secure the other of said pair of clamping plates to said second accessory member.

6. The apparatus as claimed in claim 5 wherein said means to removeably secure each of said pair of clamping plates comprises at least one threaded hole disposed in said second leg portion of said first accessory member, at least one threaded hole being disposed in the said second leg portion of said second accessory member, whereby opposed lateral surfaces of each of said pair of clamping plates are disposed in juxtaposed parallel relationship.

7. The apparatus as claimed in claim 1 wherein said third accessory member resides substantially entirely supported by said supporting surface of said intermediate portion of said first accessory member when said third accessory member is clampingly engaged therewith and when an end of said third accessory member is disposed in touching contact with said first leg of said first accessory member.

8. The apparatus as claimed in claim 1 wherein said first accessory member, said second accessory member and said third accessory member are fabricated from steel.

9. The apparatus as claimed in claim 1 wherein said first supporting block and said second supporting block and said third supporting block and said first clamping plate and said second clamping plate and said third clamping plate are fabricated from steel.

* * * * *